US006324736B1

(12) United States Patent
Atrio

(10) Patent No.: US 6,324,736 B1
(45) Date of Patent: Dec. 4, 2001

(54) FUNERAL CASKET WITH VIDEO DISPLAY UNIT

(76) Inventor: Andy Atrio, 335 Marquesa Dr., Coral Gables, FL (US) 33156

( * ) Notice: Subject to any disclaimer, the term of this patent is extended or adjusted under 35 U.S.C. 154(b) by 0 days.

(21) Appl. No.: 09/350,825

(22) Filed: Jul. 9, 1999

(51) Int. Cl.[7] ..... A61G 17/00
(52) U.S. Cl. ..... 27/2; 27/14; 27/16
(58) Field of Search ..... 27/1, 2, 14, 16, 27/27; 211/85.16; 52/103, 104; 40/124.5; D99/1, 2, 8, 17

(56) References Cited

U.S. PATENT DOCUMENTS

| | | | | |
|---|---|---|---|---|
| 494,297 | * | 3/1893 | Leonhardt | 27/2 |
| 4,457,054 | * | 7/1984 | Craft et al. . | |
| 5,426,573 | * | 6/1995 | Jenkins | 27/1 X |
| 5,533,241 | | 7/1996 | McConnell . | |
| 5,611,124 | * | 3/1997 | Biondo et al. . | |
| 5,675,876 | | 10/1997 | Benedict et al. . | |
| 5,727,291 | | 3/1998 | Biondo et al. . | |
| 5,729,921 | * | 3/1998 | Rojas . | |
| 5,732,231 | * | 3/1998 | Evans III . | |
| 5,813,099 | * | 9/1998 | Stewart | 27/2 |
| 6,237,202 | * | 5/2001 | Agee et al. | 27/14 |

* cited by examiner

*Primary Examiner*—Brian K. Green
(74) *Attorney, Agent, or Firm*—Malloy & Malloy, P.A.

(57) ABSTRACT

A funeral casket which includes a video display unit capable of playing a recording or other message containing visual images, and audio if desired, at a funeral service. The recorded message may portray selected events during the life of the deceased and is intended to be observed by mourners at the casket so as to aid mourners in coping with their sadness by helping them to more vividly recall the deceased, and hopefully, times of happiness in his or her life. In one embodiment a support member is movably connected to the funeral casket and is structured and disposed to support a video display unit thereon. The preferred support member comprises a lid structure sized and configured to be interchangeable with one of two separate lid portions commonly found on most funeral caskets. The preferred lid structure includes an outer exposed surface that closely mirrors the overall design and configuration of the casket and an inner recessed surface structured to receive the video display unit therein, which can be readily viewed by mourners when disposed in an open position suited for an open casket ceremony. The casket and/or lid structure also includes electronic circuitry, preferably hidden from view, which is suited for providing electrical connection of the video display unit to a power source.

4 Claims, 4 Drawing Sheets

FUNERAL CASKET WITH VIDEO DISPLAY UNIT

BACKGROUND OF THE INVENTION

1. Field of the Invention

This invention relates generally to funeral caskets, and more in particular, to a funeral casket which includes a video display unit, which may be supported on or attached to the casket, for observation by one or more mourners attending a service for a deceased person lying within the casket. In one preferred embodiment, the funeral casket of the present invention includes an interchangeable, supporting lid structure onto which the video display unit may be disposed, which lid structure preferably also includes electrical circuit means, hidden from observation by the mourners, to energize the video display unit with electrical current.

2. Description of the Related Art

It has been said that there are two certainties in life, one of which is death and the other of which is the payment of taxes. During contemporary times, it is common for a person who just recently passed away to be viewed for a final time by his family, friends and other mourners. Usually, this final viewing takes place at a funeral home, also called a funeral parlor, with the deceased lying in a funeral casket that is presented at one end of a selected room within the funeral home so that mourners can walk up to the casket and view the deceased, pay their last respects, say a prayer, etc. If circumstances permit, the casket will be partially opened to reveal the deceased's face, neck, arms and upper torso, although there are times when the casket will be closed so that viewing of the deceased is not possible. Oftentimes, a brief religious observance will also be performed at such funeral services.

A person's death is usually announced in the local newspaper, and might appear in the obituary column, with a few details given as to the person's identity, accomplishments, surviving family, etc. along with information as to the place and time of a funeral service for the deceased. The obituary column, however, does not readily accommodate many details as to the life of the deceased, and further, may not be a preferred forum for such details, even if it were. It is believed that there are many families who would like to provide the attendees of a funeral service for a deceased loved one with some additional details as to the deceased. However, there is usually not much space in the rooms of the funeral home where the casket and/or funeral service is located, and so, any such display must be limited in size. For example, some families of a deceased person will prepare a very small display for the funeral service in the nature of a simple poster held on an easel that contains several photographs of the decedent during his or her lifetime and other memorabilia. Even this type of display, however, falls short of providing any meaningful insight into the decedent's life. For instance, there is typically not enough room to provide a brief history for the deceased, such as when and where he was born, who were his parents, his education and/or career, important events in his lifetime, etc. nor is there enough room for those stories that might be told about the deceased which succinctly define his personality. If these more informative details could be presented, it might help those attending the funeral home to fully appreciate the deceased, and how much he meant to others.

Even if it were possible to present at a funeral service such colorful details as to a particular deceased person, there will almost certainly be some people who knew the deceased, who were acquainted with him, or possibly even related to him, that could not attend the funeral service. This is especially true for those who do not live in the geographical place where the service is to be held, as in many cases, that place will be where burial is to occur, and not necessarily the area where the decedent lived for most of his or her life. As such, it would be highly beneficial if a display were developed which could meet the needs mentioned above, and at the same time, be reduced to a reproducible, transportable, and permanent form, so that those who could not attend the funeral service might later observe the display, and/or so that even those who did attend the funeral service might be permitted to repeat an earlier observation of the display.

One effort to address these needs in the art comprises the provision of an apparatus, such as a personal computer with a display terminal and a keyboard, in a funeral home, such as in the lobby of the funeral home. The personal computer of this known apparatus may be set up to display information such as written text and/or visual images that describe the life experiences of one or more deceased persons currently laid out at the funeral home, with the capability of permitting individual viewers to select which decedent's information is to be displayed at any one time. The personal computer of this known apparatus further permits copies of the information to be made so that it can be kept permanently and also permits the entry of additional personal information about the deceased, such as by visitors to the funeral home. It is pointed out that the latter feature, however, could subject the system to acts of vandalism such as by a visitor's unauthorized entry of profanity or disrespectful information about the deceased. This type of known apparatus suffers from other drawbacks, however. For instance, this type of apparatus would not be likely to fit conveniently or efficiently within the actual room where the funeral casket holding the deceased is located, and even if it were, the manipulation of a key board to display detailed information about the deceased or to obtain a permanent record of that information would likely be an unwelcome distraction to other mourners attending the service. In addition, the attendees of a funeral home service and/or other visitors might find such an apparatus intimidating in that some knowledge of personal computers would be required in order to operate it, and as such, it might not be used very often.

Accordingly, there remains a need in the art relating to funerals for a device which permits a decedent's family and loved ones to effectively display at a funeral service more detailed information about the decedent so as to convey to the attendees more detailed, and hopefully, uplifting information about the decedent, such as his or her important achievements and any other colorful information which might demonstrate that he or she led a rich and full life. So as to advance the state of the art and address the needs which remain in the art, any such device should be able to fit conveniently and discreetly within the room where the funeral casket holding the deceased is to be located, without causing an unwelcome distraction to mourners. In addition, any such device should be structured so as to readily permit the operation thereof so as to encourage its use at a funeral service.

SUMMARY OF THE INVENTION

The present invention is designed to meet these and other needs which remain in the art and is directed to a funeral casket which includes a video display unit. More in particular, the present invention is intended to discreetly combine a funeral casket with a video display unit, into which a pre-recorded message can be inserted for the playing of visual images, and audio as well if desired, at the funeral service. The recorded message may portray selected events during the life of the deceased, such as where and when he or she was born, where he or she lived over the years, important events in his or her life, and his or her relationships with family and friends. Simply put, as people are saddened by the death of a person whom they knew, and as they sometimes remain beside the casket containing the deceased for an extended period of time feeling great stress and sorrow, the present invention is intended to aid mourners by helping them to more vividly recall the deceased, and hopefully, times of happiness in his or her life.

As such, the present invention comprises in one embodiment a casket which is structured to include a video display unit on the body of the casket so as to permit viewing of the display unit by one or more mourners situated near the casket. This embodiment of the invention additionally includes electrical circuit means on the casket for interconnecting and/or connecting the video display unit to a power source which may be, but does not have to be, located exteriorly of the casket. In a more preferred embodiment, the funeral casket includes a support means for supporting the video display unit on or in close adjacent relation to the casket. More specifically, this embodiment of the present invention comprises a support member which is movably connected to the funeral casket and which is structured and disposed to support a video display unit thereon in substantially close, generally adjacent relation to the casket. In a preferred embodiment, the support member comprises a lid structure which is sized and configured to be interchangeable with one of two separate lid portions which are commonly found on most funeral caskets. The lid structure includes an inner surface and an outer surface and means for movably connecting the lid structure to the casket. The connecting means preferably, but not necessarily, permit the lid structure to be movable between an open position and a closed position. In addition, the connecting means can be structured to be selectively released, if desired, so as to permit the removal of the lid structure following use of the video display unit supported thereby at a funeral service and the replacement of the lid structure with the original lid or portion thereof that was temporarily removed from the casket in preparation for the funeral service. Also in the preferred embodiment, the inner surface of the lid structure is recessed or generally concave, and further, is sized and configured to mountingly receive the video display unit therein, so that the video display unit may be readily and yet discretely observed by mourners during an open casket service.

In an alternative embodiment, the support member is attached to an outer surface of the casket, such as but not limited to, the outer surface of a lid structure for the casket, in contemplation of a closed casket funeral service. More in particular, the support member may in one embodiment be either mounted to or movably connected to the lid structure in a manner which presents the video display unit for viewing by mourners. The support member of this embodiment may include a video display unit integrally formed therewith. In yet another alternative embodiment, the support member may be movably connected to the casket itself and not necessarily to a lid or lid portion for the casket. For instance, the support member may be slidingly received within a portion of the casket and movable between a stored position and an operative position in which a video display unit might be supported thereon.

The present invention further contemplates an editing service to create a single video tape or other playable message such as on a compact disk, which may be offered by the funeral home itself or an independent editing service. For example, the playable message might be obtained by the family of a deceased person providing the funeral home with selected video tapes and/or other video and audio images of the deceased during certain events in his or her lifetime, which could then be edited to result in a single recorded presentation of the selected images in logical order. When this recording or other playable message is presented at the funeral service for the deceased, such as on a video display unit associated with the present invention, the result should be that of a more vivid and lasting description as to the life of the deceased might be shared with his or her family, friends and other mourners attending the funeral service. In addition, the present invention also contemplates a reproduction and storage service, whereby the funeral home might store a master copy of the recorded presentation or other playable message, and if desired, prepare copies from the master copy of the recorded presentation or other playable message for a particular decedent, in order that a mourner who could not attend the funeral service might later have a feeling of some participation in the service and/or so that even those who did attend the funeral service might be permitted to repeat an earlier observation of the recording or presentation. Finally, the present invention additionally contemplates a creative video service, whereby personnel of the funeral home or an independent video filming service associated therewith might record the events which transpire at a funeral service, and edit them in a pleasing way, so that a video tape or other recording might be offered to the close family and friends of a deceased in order for them to better remember those events over the ensuing years.

Accordingly, it is a primary object of the present invention to provide an apparatus, as well a service if desired, which permits the family and loved ones of a deceased person to effectively display at a funeral service more detailed information about the decedent so as to convey to the attendees the decedent's important achievements and any other information which might demonstrate that he or she led a rich and full life.

Another important object of the present invention is to provide a funeral casket or coffin in combination with a video display unit.

Yet another object of the present invention is to provide a combined funeral casket with a video display unit which in one embodiment includes an interchangeable, supporting lid structure for the casket onto which the video display unit may be disposed, which lid structure may additionally include electrical circuit means, hidden from observation by the mourners, to energize the video display unit with electrical current.

An advantage of the present invention is that it may conveniently and discreetly fit within almost any room selected within the funeral establishment wherein the funeral casket holding the deceased is to be located, without causing an unwelcome distraction to mourners.

Of course, the foregoing are not the only objects, features or advantages of the present invention, as will become more clear from the detailed description of the invention which follows. It is to be noted, however, that while the following describes the invention in various preferred embodiments, the precise structure of the invention may be further altered by an equivalent structure, so as to achieve a not insubstantially different invention, that should still be considered to fall within the,spirit and scope of the present invention.

BRIEF DESCRIPTION OF THE DRAWINGS

For a fuller understanding of the nature of the present invention, reference should be had to the following detailed description and the accompanying drawings in which.

Like reference numerals refer to like parts throughout the several views of the drawings.

DETAILED DESCRIPTION OF THE PREFERRED EMBODIMENTS

As shown in the accompanying drawings, the present invention is directed to a funeral casket, 10, which includes a video display unit 20.

Figure 1:
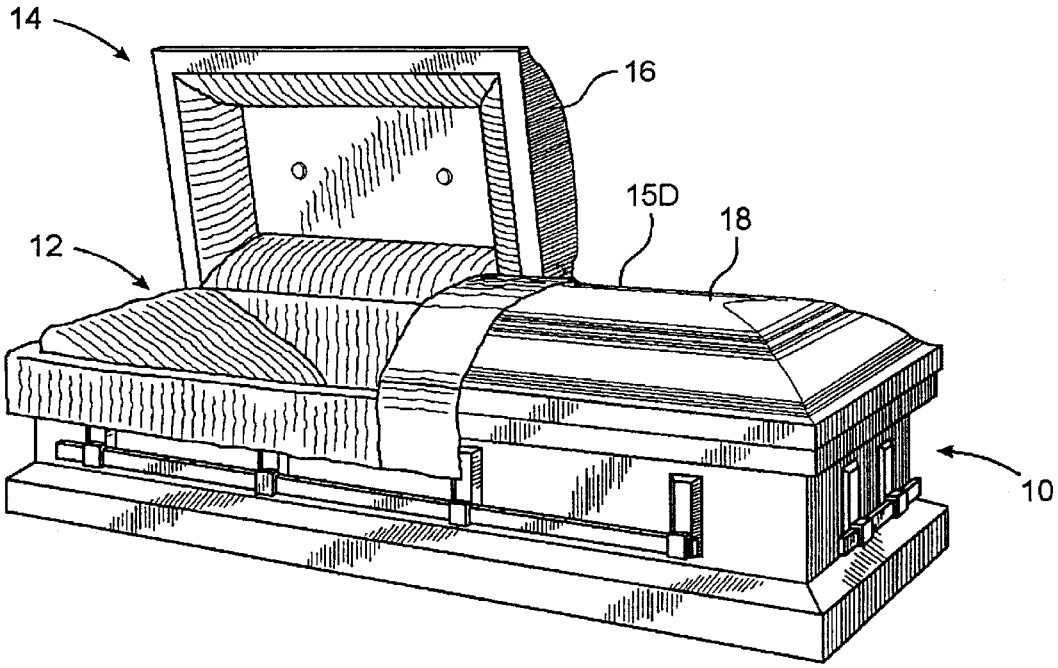
FIG. 1 PRIOR ART
FIG. 1 is a perspective view of a relatively common funeral casket.

By way of background, and with reference to FIG. 1, funeral caskets are generally rectangular in shape and are sized to receive the remains of a deceased person, which are arranged within the casket interior 12. Funeral caskets can be, and generally are, fabricated to accommodate various sized deceased persons, and further, can be fabricated to accommodate many different styling preferences. For example, funeral caskets can be made from many different types of materials, such as wood, which is usually less expensive, to high gauge steel, such as 20 gauge steel, which is usually more expensive. Regardless of size or material, each casket is generally provided with a top section or lid 14, for providing access to the casket interior 12. Still referring to FIG. 1, it is relatively common for the top section or lid 14 of the funeral casket 10 to comprise two separate lid portions, 16 and 18, each of which can be opened or closed to selectively display the deceased lying within the casket interior 12 at a funeral service. Thus, the lid portions 16, 18 are connected to a side wall of the funeral casket, such as side wall 15-D, along or adjacent an upper edge thereof by suitable hinge members, not shown.

Figure 7:
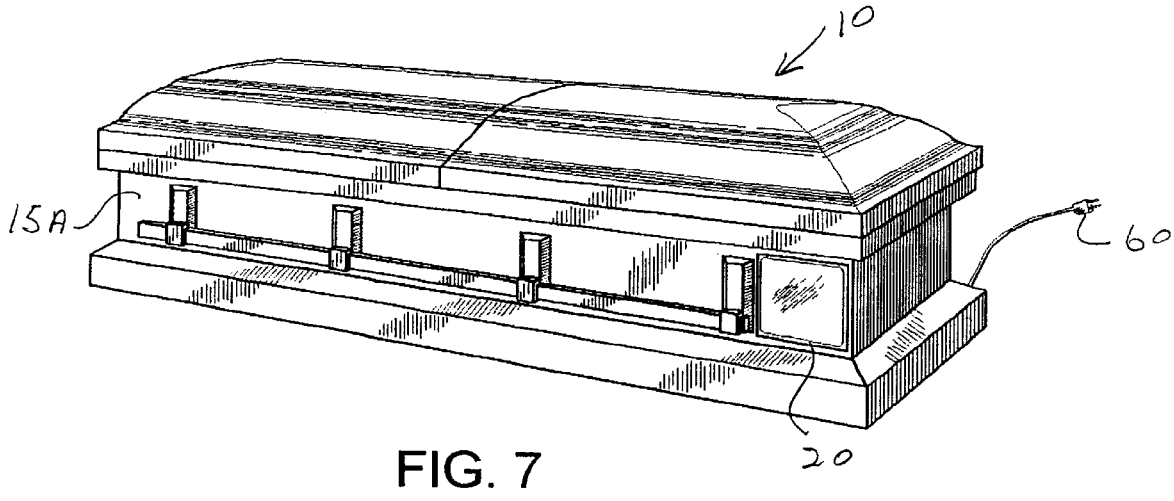

In a first possible embodiment, illustrated in FIG. 7, the present invention comprises a funeral casket which is structured to include a video display unit 20 disposed directly on the body of the casket 10. In this embodiment, it is preferable that at least the viewing screen of the video display unit 20 be disposed within one of the vertical upstanding side walls of the casket 10, such as 15-A, so as to be flush therewith and to give the casket an aesthetically pleasing appearance, and further, for the viewing screen to be disposed on a portion of the casket which readily permits observation thereof by one or more mourners situated near the casket, whether he, she or they be sitting, standing, or kneeling. It would also be within the spirit and scope of this embodiment of the invention to dispose at least the viewing screen of the video display unit on or within the top section or lid 14 of the casket 10, as well. In either case, this embodiment of the present invention further includes electrical circuit means mounted on and/or within the casket 10 or lid 14 therefor for electrically connecting and/or coupling the video display unit 20 to a power source, which may be, but does not have to be, located exteriorly of the casket 10. The remaining operative components of the video display unit 20, such as those which permit the insertion and playing for viewing by the mourners of a playable medium, such as a video tape edited to carry images of the deceased during his or her lifetime, and which will not be recited here as they are known to persons of skill in the relevant art, could be housed within or adjacent to the casket 10.

In the preferred embodiments, however, the present invention is directed to support means, 30, such as a support member connected to or interconnected with the funeral casket 10, for supporting a video display unit 20 in substantially close, generally adjacent relation to the casket, 10. As will become more clear from the description which follows, it is preferred that the support means 30 also be structured to blend harmoniously and aesthetically with the overall look, design and configuration of the funeral casket, 10.

Figure 2:
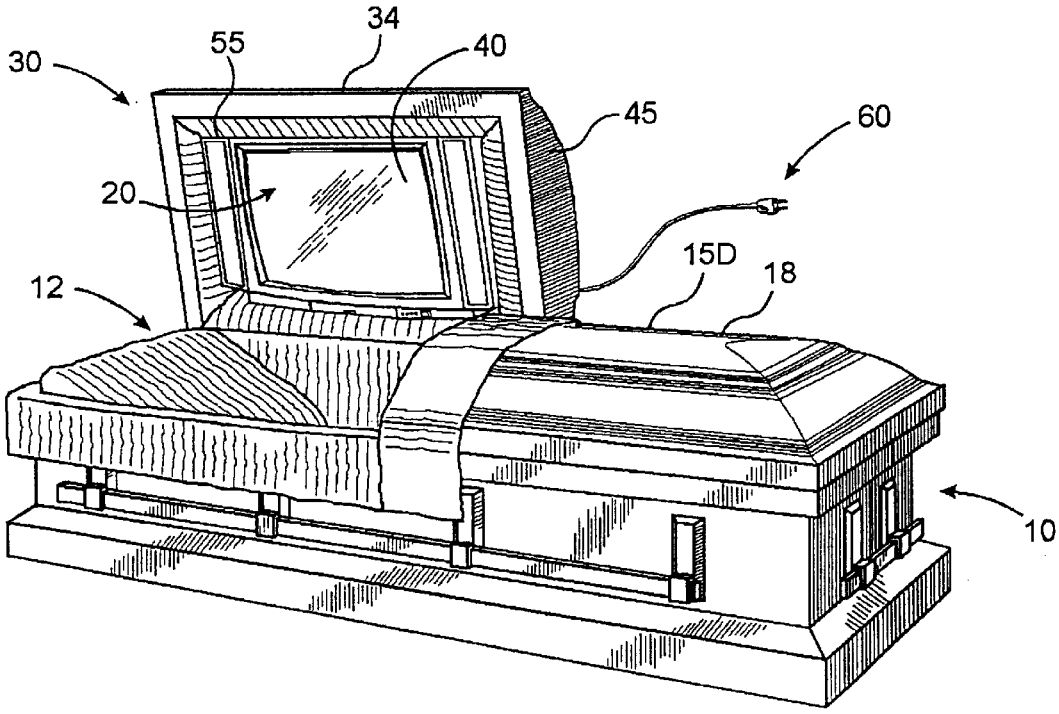
FIG. 2 is a perspective view of a funeral casket according to one embodiment of the present invention.
Figure 8:
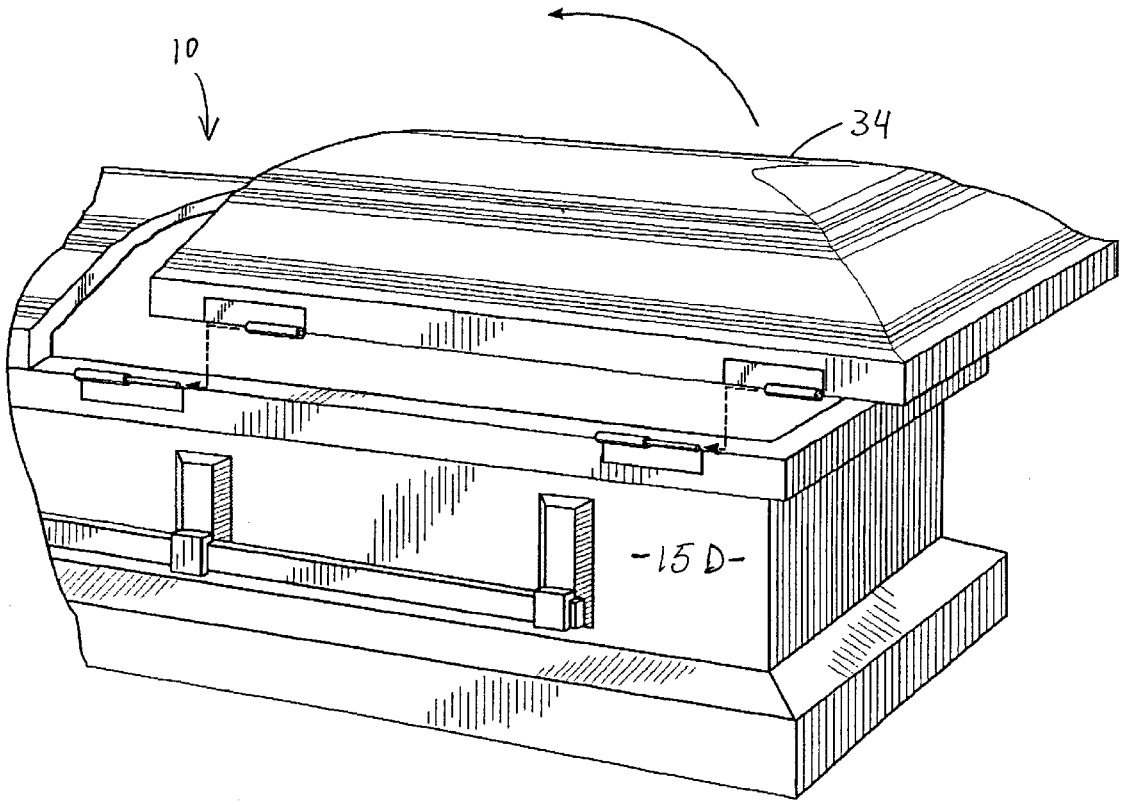
FIG. 8 is a partial, rear perspective view of the invention depicted in FIG. 2 and illustrating a hinge structure.

Accordingly, with reference now to FIGS. 2 through 6, the present invention seen to preferably comprise support means 30 for supporting a video display unit in substantially close, generally adjacent relation to the casket, 10. As illustrated in FIG. 2, the support means 30 may comprise a support member which is connected to or interconnected with the funeral casket 10. Preferably, the support member comprises a supporting lid structure 34 which is sized and configured to be interchangeable with one of the two separate lid portions, 16 and 18, seen in FIG. 1, which are commonly associated with most funeral caskets 10. More in particular, the preferred supporting lid structure 34 will include an outer exposed surface 45 which is sized and configured to closely, if not identically, match the exterior surface configuration and material of one of the lid portions 16 or 18 for a selected funeral casket, 10, whether made of steel, wood or another material. The preferred supporting lid structure 34 will also include a hinge structure (see FIG. 8) mounted on a rear edge thereof, which will be described in greater detail below, to permit the supporting lid structure 34 to be mounted to a funeral casket 10 and displayed at least in an open position, shown in FIG. 2, so as to correspond to an open casket ceremony. The hinge structure could also be structured to permit the selective movement of the supporting lid structure 34 between the open position illustrated in FIG. 2 and a closed position, if desired. In addition to the outer exposed surface 45, the preferred supporting lid structure 34 will also include an inner surface 40 which is structured to support a video display unit 20 thereon. The preferred embodiment of FIG. 2 illustrates a supporting lid structure 34 having a recessed or generally concave inner surface 40 into which the video display unit 20 may be mounted. The video display unit 20, which may comprise a television screen integrally formed with and/or operably connected to a video-cassette recorder and player (VCR) machine, is preferably a relatively standard, commercially available device, ideally in an off-the-shelf size so as to need little or no modification prior to being inserted within the recessed, inner surface 40 of the supporting lid structure 34. The inner surface 40 of the supporting lid structure 34 preferably also includes suitable mounting structure 55, which might include the affixation of a rigid flange extending about the peripheral regions of the inner surface 40 after insertion of the video display unit therein, to securely retain the video display unit 20 within the lid structure 34, while preserving an overall, aesthetically pleasing appearance of the funeral casket 10.

As noted above, the preferred supporting lid structure 34 shown in FIG. 2 will also include a hinge structure which preferably is mounted on a rear edge thereof, for purposes which are about to become clear. More in particular, it would make the most economic sense for the present invention to comprise a supporting lid structure 34 having a video display unit 20 already mounted thereto which is readily interchangeable with one of the two separate lid portions, 16 or 18, for the funeral casket 10. As the lid portions 16 or 18 found on a funeral casket are most often connected to a side wall of the funeral casket, such as side wall 15-D, along or adjacent an upper edge thereof by a suitable hinge members, it would be preferable to provide the supporting lid structure 34 with a hinge structure in the same location, which will mate with or otherwise cooperate with the hinge structure formed on the funeral casket 10. As such, in preparation for a funeral service one of the lid portions 16 or 18 corresponding a desired location on the casket 10 might be removed from the casket 10 for replacement with the preferred supporting lid structure 34 having a video display unit 20 mounted thereto. The hinge structure might readily permit the supporting lid structure 34 to be easily removed following a funeral service, such as by removal of a bolt, hinge pin or the like, for replacement of the original lid portion 16 or 18 prior to interment, if that is desired. Regardless of whether this interchangeable feature is included or not, the outer exposed surface 45 of the supporting lid structure 34 would preferably, but not necessarily, be manufactured at the same time as the lid portions 16 and 18 for funeral casket 10 so as to closely correspond to the overall look and appearance of the casket 10.

Still referring to FIG. 2, the support means 30 preferably include, but do not necessarily have to include, electrical circuit means 60 for providing an electrical connection of the video display unit 20 to a power source. By way of example only, the video display unit 20, which if purchased as an off-the-shelf item or other relatively standard and commercially available item would already include an electrical cord for purposes of being plugged into a wall socket, and could be plugged into an electrical socket (not shown) disposed in a somewhat hidden location within the recessed inner surface 40 of supporting lid structure 34. Suitable cable or wiring could then be included within lid structure 34 so as to electrically interconnect the electrical socket to a power source, which might comprise a battery also located and yet concealed within the lid structure 34 or which alternatively might comprise a plug structure located exteriorly of the supporting lid structure 34 and casket 10, which might then be electrically connected to a wall socket as the power source. Alternatively, the supporting lid structure 34 might be formed to include an aperture located in a somewhat hidden location at a rear portion thereof, which is sized and configured to permit passage therethrough of an electrical cord interconnecting the video display unit 20 with an exteriorly located power source.

Figure 3:
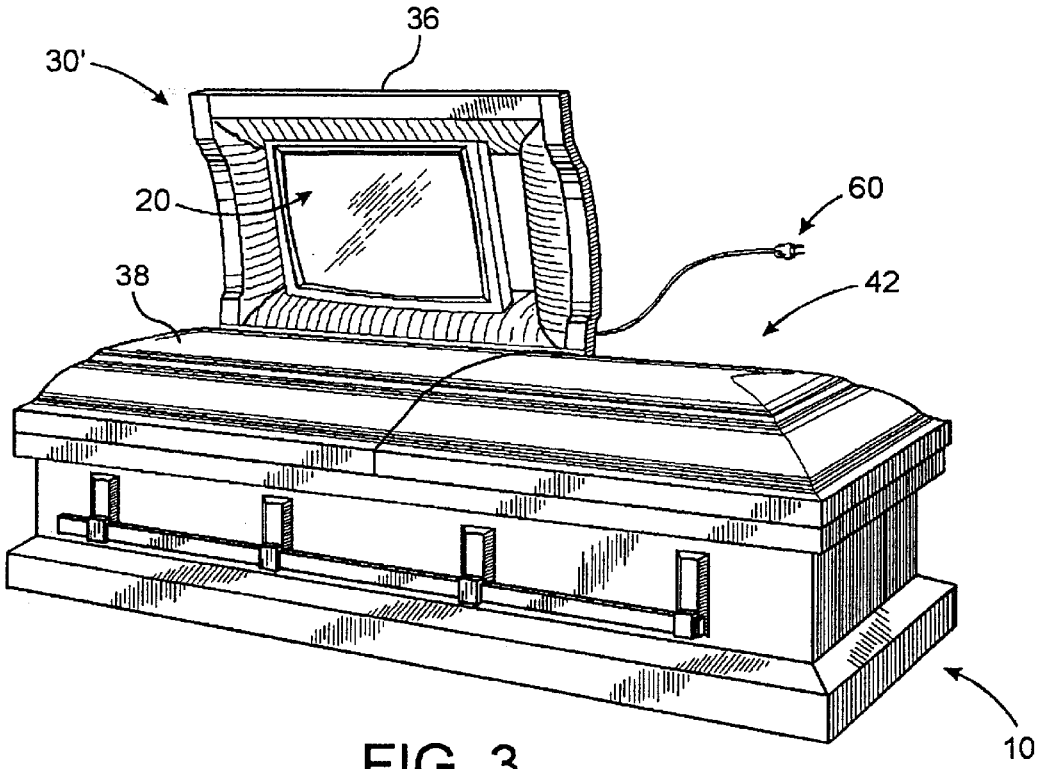
FIG. 3 is a view similar to FIG. 2 illustrating a somewhat modified embodiment of the present invention.

With reference now to FIG. 3, the support means 30' of the present invention is shown in an alternative embodiment for supporting a video display unit 20 on or in adjacent relation to the casket, 10. The support means 30' of this embodiment, which might be preferred for a closed casket funeral service, may comprise a support member 36 connected to an outer exposed surface 42 of the casket 10, such as adjacent or on to an exterior portion of lid structure 38. The support member 36 of this embodiment is also structured and disposed to present a video display unit 20 for viewing by mourners, and preferably, but not necessarily, is mounted to the casket so as to be movable between an open, operative position illustrated in FIG. 3, and a closed, stored position (not shown) with the support member 36 ideally structured to rest on and conform to the overall configuration of lid structure's exterior surface 38. It should be pointed out, however, that the support member 36 could also be only temporarily mounted to the casket 10, and further, to assume only one position, such as that shown in FIG. 3. In addition, the support member 36 of this embodiment may include a video display unit 20 integrally formed therewith, as shown in FIG. 3. Here again, the support member 36 preferably also includes electrical circuit means (not shown) for providing an electrical connection or interconnection of the video display unit 20 to a power source.

Figure 4:
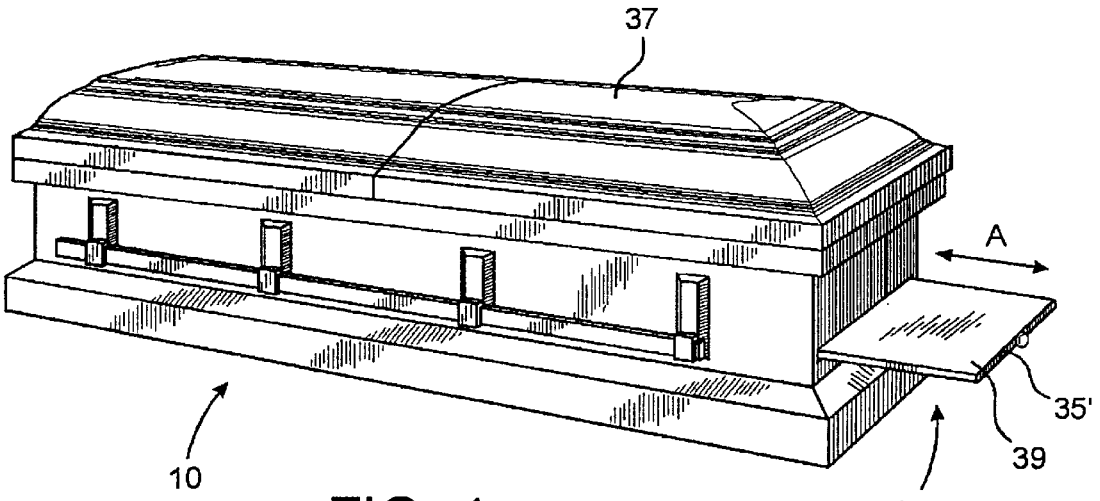
FIG. 4 is also a perspective view of a funeral casket according to the present invention and illustrating yet another embodiment.
Figure 5:
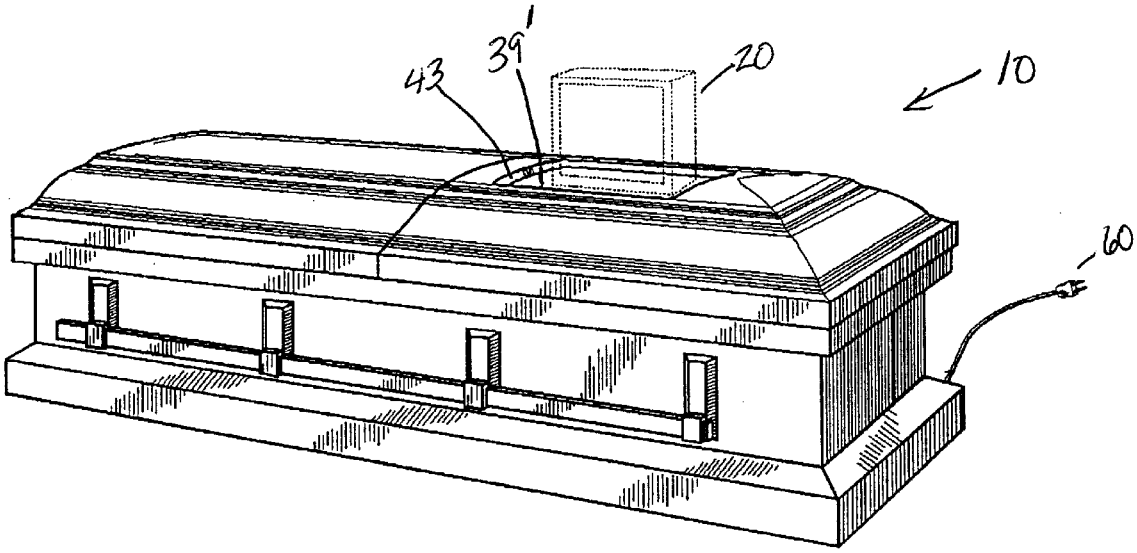
FIGS. 5, 6 and 7 are also perspective views of a funeral casket according to the present invention but illustrating yet additional possible embodiments.

With reference now to FIG. 4, the support means 30" of the present invention is shown in yet another alternative embodiment for supporting a video display unit (not shown) on or in adjacent relation to the casket, 10. The support means 30" may comprise a support member 39 that is movably connected to the casket itself, and not necessarily to a lid or lid portion for the casket. For instance, the support member 39 may be slidingly received within a portion of the casket and movable in the direction shown by the arrow A in FIG. 4, between a stored position and an operative position, as shown in FIG. 4, in which a video display unit might be supported thereon. Thus, the support member 39 of this embodiment can in some ways be analogized to a drawer. It should be pointed out, however, that the support member 39 might also take the form of a movable support shelf disposed exteriorly on the casket 10 or a portion of the lid 38 for the casket. As yet another alternative, and with reference now to FIG. 5, the support member 39' might comprise a horizontal support surface disposed within the lid portion of the coffin, which could be normally hidden from view by a slidable member 43, which is movable between an open position, as shown, and a closed position.

Figure 6:
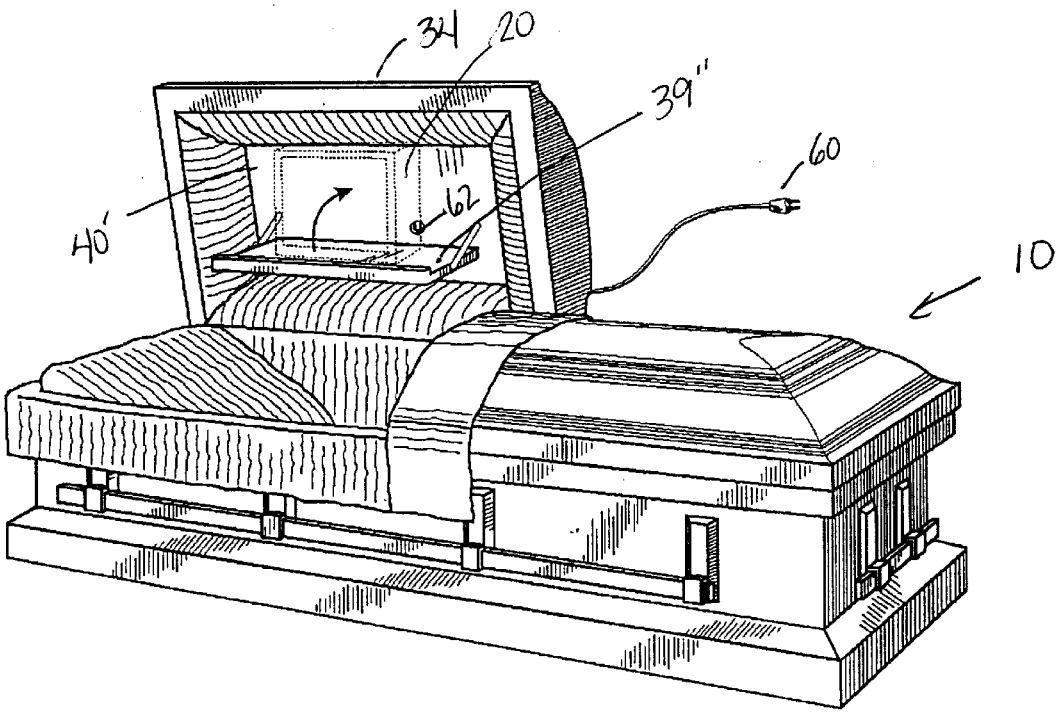

As yet another alternative, and with reference now to FIG. 6, the support member might take the form of a movable support shelf 39" disposed on an inner surface 40 of the lid structure 34 and hingedly connected thereto to act as a drop-down shelf which presents a horizontal support surface on which a video display unit 20, shown in phantom lines, may be positioned and supported. As has been described with respect to the other embodiments, electrical connection means, such as a suitable wiring or a cable terminating in a plug (not shown) may extend from the video display unit 20 for purposes of being plugged into a socket 62, disposed on the inner surface 40' of lid structure 34 in a hidden location, may be included to electrically connect the video display unit 20 to a power source. The video display unit 20 in this embodiment may, therefore, be more conveniently arranged at a height relative to casket 10 which is commensurate for viewing by a mourner kneeling on a cushion support as is customarily provided adjacent the casket 10. The mourner is thus provided with a convenient line of sight as to both the deceased and the video display unit 20 while kneeling and paying final respects to the deceased.

In use, a video display unit 20 is structured to receive a video tape, other recording or other playable message, and to display visual images, whether moving pictures or a series of still pictures, written text and the like, as well as sound or music. As such, and as noted previously, the present invention further contemplates an editing service to create a single video tape or other recording and/or playable message, which service could be offered by funeral home personnel or an independent editing service. For example, a person preparing for his or her own death might engage the service of the funeral home or the independent editing service to create a personal, customized visual and audio recording to be played at the funeral service which could function as a message of condolence from the grave. Alternatively, the family of the deceased might provide the funeral home with selected video tapes and/or other video images and/or audio recordings of the deceased during certain events in his or her lifetime, which could be edited to make a single recorded presentation. Hopefully, the recorded presentation would provide uplifting information about the decedent, such as his or her important achievements and any other details which might demonstrate that he or she led a rich and full life. The goal of the present invention is to have a such a visual and audible aid "played" in close proximity to the casket holding the deceased, as this is the location at which most mourners are hit with the finality of death, so that a vivid description as to the fullness of life enjoyed by the deceased might be shared with his or her family, friends and other mourners attending a funeral service. Thus, the recorded presentation or other playable message would preferably be inserted into the video display unit 20 prior to the funeral service for playback and viewing by mourners attending the service, which might occur at a set time. Alternatively, the video display unit 20 might include or be operably connected to certain operative components which would permit the playback functions (and rewind function, if necessary) to be programmed to automatically occur at set intervals during the service, such as every thirty minutes. While operation of the video display unit 20 could be controlled by one of the attendees at the funeral service, such as by pushing a visually discernable "playback" button on the unit 20, it is preferred that operational control of the unit 20 remain in the hands of the funeral home and its personnel. By way of example only, the video display unit 20 could be interconnected by way of cable wiring, etc. with a central processing unit (CPU) in the form a computer with microprocessor located in the office of the funeral home and could be programmed to play the recorded presentation or other playable message at set intervals, with the possibility of displaying on the unit 20 during the periods of non-play, selected still video image(s) such as the name of the deceased, a comforting prayer, a religious message, an image of preying hands, etc., any or all of which may or may not be accompanied by a pre-determined and/or appropriate music selection for the somber occasion.

In addition, the present invention also contemplates a reproduction and storage service, whereby the funeral home might store a master copy of the recorded presentation, and if desired, prepare copies of the master recorded presentation or other playable message relating to a particular decedent, in order that a mourner who could not attend the funeral service might later have a feeling of some participation in the service, and/or so that even those who did attend the funeral service might be permitted to repeat an earlier observation of the recording or presentation.

Finally, the present invention additionally contemplates a creative video service, whereby personnel of the funeral home or an independent video filming service associated therewith might record the events which transpire at a funeral service, and edit them in a pleasing way, so that a video tape or other recording might be offered to the close family and friends of a deceased in order that for them to better remembered those events over the ensuing years.

Since many modifications, variations and changes in detail can be made to the various preferred embodiments of the invention, described in this section, it is intended that all matters in the foregoing description and shown in the accompanying drawings be interpreted as illustrative and not in a limiting sense. Thus, the spirit and scope of the present invention should not to be limited to the precise structure recited in the foregoing description, but rather, should be determined by the appended claims and their legal equivalents.

Now that the invention has been described,

What is claimed is:

1. A funeral casket including:

a) a lid having an inner and outer surface;

b) hinge means on said lid and said casket for permitting swinging movement of said lid between an open and closed position;

c) said lid including a drop down, swingable shelf to support and orient a video display unit in a horizontal attitude; and d) electrical circuit means including a portion on said casket for electrical connection of the video display unit to a power source.

2. A casket as set forth in claim 1 wherein said lid includes a partial lid portion and said drop down, swingable shelf is provided on the casket adjacent said partial lid portion.

3. A funeral casket comprising:

a) a lid sized and structured to at least partially close the casket, said lid having an inner and an outer surface;

b) a hinge structure interconnected between said lid and said casket for permitting swinging movement of said lid between an open and closed position;

c) said lid including a shelf swingably mounted to said inner surface and movable between a first, stored position and a second, operative position, said shelf being structured and disposed to support and orient a video display unit in a horizontal attitude thereon for viewing when said shelf is disposed in said operative position;

d) said video display unit supported on said shelf and oriented such that it is viewable by one or more persons located near the front of said casket; and e) electrical circuit means including a portion on said casket for electrical connection of said video display unit to a power source.

4. For a funeral casket structured and sized to hold the body of a deceased person, a lid assembly comprising:

a) at least two lid portions collectively sized and structured to cover the casket;

b) at least one of said lid portions including:

i) an interior and an exterior surface ii) a hinge structure for interconnecting said lid portion to the casket and for disposing said lid in at least a generally upright and open position relative to the casket;

iii) a video display unit securely retained within said interior surface of said lid portion and oriented to display visual images when said lid portion is in said generally upright and open position so as to be viewable by one or more persons located near the casket;

c) said hinge structure being further structured and disposed to facilitate quick removal of said lid portion from the casket and replacement by another one of said lid portions not including a video display unit; and d) electrical circuit means at least partially on the casket for providing an electrical connection of said video display unit to a power source.

* * * * *